United States Patent [19]

Walker

[11] Patent Number: 5,069,040

[45] Date of Patent: Dec. 3, 1991

[54] COIL BYPASS ARRANGEMENT

[75] Inventor: Mark A. Walker, Dallas, Tex.

[73] Assignee: Lennox Industries Inc., Carrollton, Tex.

[21] Appl. No.: 604,863

[22] Filed: Oct. 29, 1990

[51] Int. Cl.[5] ..... F25D 17/00

[52] U.S. Cl. ..... 62/181; 62/187; 62/DIG. 17

[58] Field of Search ..... 62/DIG. 17, 181–184, 62/187, 428

[56] References Cited

U.S. PATENT DOCUMENTS

| | | | |
|---|---|---|---|
| 2,332,730 | 10/1943 | Kucher | 62/187 |
| 2,959,933 | 11/1960 | Burke | 62/428 X |
| 3,151,469 | 10/1964 | Quick | 62/187 X |

*Primary Examiner*—William E. Wayner

*Attorney, Agent, or Firm*—Allegretti & Witcoff, Ltd.

[57] ABSTRACT

A condensing unit has a housing with a pair of compartments separated by a common wall. Within each compartment is a coil, a fan for passing air over said coil and a compressor operatively interconnected with the coil. There is an opening in the common wall that is opened and closed by a damper. The damper is rotatably or pivotally secured to the common wall to open and close the opening therein. A damper motor is provided for actuating the damper is response to attainment of a predetermined refrigerant pressure in the refrigeration system in the first compartment. Opening of the damper allows air to be drawn from the inoperative second compartment through the first compartment, resulting in a reduced pressure differential across the coil in the first compartment and a reduction in the air flow across the coil in the first compartment. With the reduced air flow, the pressure in the refrigeration system in the first compartment will rise to a predetermined level and the damper motor will be deenergized. A spring may be provided to bias the damper to the closed position.

12 Claims, 2 Drawing Sheets

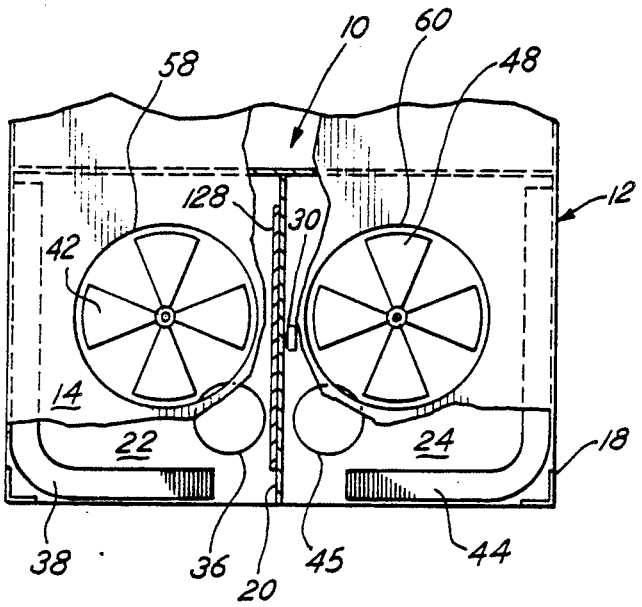
Fig. 3
Fig. 4
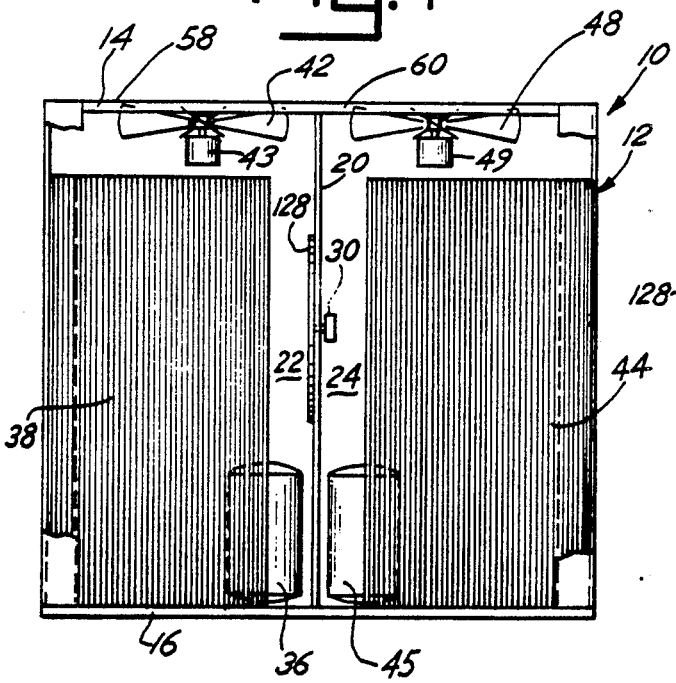
Fig. 5
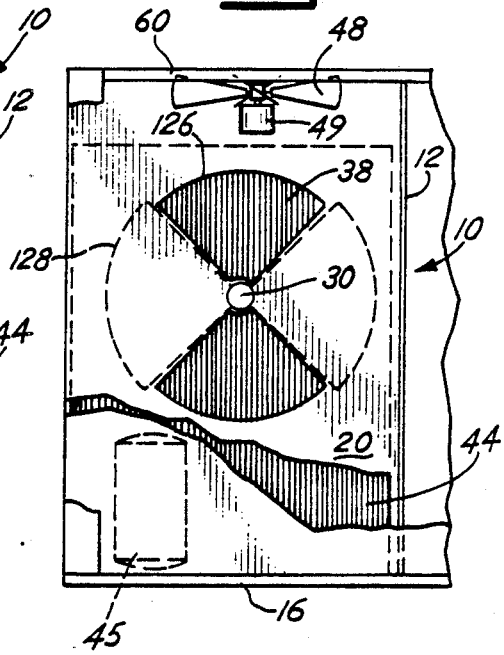

COIL BYPASS ARRANGEMENT

BACKGROUND OF THE INVENTION

The present invention relates to a condensing unit for an air conditioning system having a housing with a pair of compartments separated by a common wall and a damper for opening and closing an opening in said common wall to provide for more efficient cooling under ambient temperatures of 60° F. or below.

Vapor-cycle based air conditioning systems are typically limited in their ability to provide cooling to a building when the outdoor air temperature drops below about 60° F. Such system generally comprises a compressor, a condenser coil, expansion means and an evaporator coil operatively interconnected to form the system.

Basically, high-pressure vaporous refrigerant compressed by the compressor is condensed in the condenser. The liquid refrigerant passes through a refrigerant line to the expansion means, where it is metered. The expansion means may be a capillary tube, or a thermal expansion valve. The metered refrigerant passes from the expansion means to the evaporator coil. Air to be cooled is passed over the evaporator coil. Refrigerant gas from the evaporator coil is returned to the compressor through the suction line and the cycle is repeated.

As the outdoor air temperature falls below 60° F., the air circulated over the condenser coil, generally by a fan associated with the condenser coil, causes the refrigerant gas to cool and condense quickly so that the pressure in the refrigerant line to the expansion means falls to unacceptable levels.

Prior solutions to the problem of cooling when the ambient temperature falls below about 60° F. were to reduce the air flow across the condenser coil by slowing the speed of the condenser fan, to cycle the condenser fan on and off or to mechanically block off a portion of the surface of the condenser coil. Stewart's U.S. Pat. No. 3,112,620 shows a refrigeration system with an air-cooled condenser with three separate fans incorporating a control to terminate operation of one fan in response to a predetermined low temperature and thereby increase the condensing pressure. Dapper's U.S. Pat. No. 3,366,167 relates to a refrigeration system with a condensing unit which employs multiple fans, one of which may be turned off to prevent an undesirably low condensing pressure. Neither of these patents suggests the present invention.

Burke's U.S. Pat. No. 2,959,933 discloses a heat pump having an outdoor unit with a damper in a wall separating two compartments, the first compartment containing the compressor and the reversing valve and the second compartment containing the condenser coil and condenser fan. The damper is opened and closed by bimetallic members 32 and 34, which are responsive to the temperature in the two compartments in the outdoor unit. When the resultant temperature of the bimetallic members drops below about 50° F., the damper is closed and the radiant heat generated by the compressor and motor driving the compressor is trapped in the compartment containing the compressor and reversing valve. When the resultant temperature of the bimetallic members exceeds about 50° F., the damper is opened and air may circulate over the compressor, as shown in FIG. 2 of Burke's U.S. Pat. No. 2,959,933, to cool same. The heating cycle of the heat pump of Burke is intended to operate at a higher temperature level to provide a greater heating effect. Burke does not suggest the condensing unit structure of the present invention or its novel mode of operation.

An object of the present invention is to provide an improved condensing unit having a bypass damper in a common wall between two compartments in the condensing unit, for improving performance during cooling operation at outdoor air temperatures below a predetermined level.

Another object of the present invention is to provide an improved condensing unit for a refrigeration system, said condensing unit having two compartments each containing a condenser coil and fan, with a bypass damper in a common wall between the two compartments for permitting air to pass between the two compartments when the outdoor air temperature drops below a predetermined level.

A further object of the present invention is to provide a condensing unit with first- and second-stage compartments each containing a compressor, a condensing coil and a fan, a common wall containing a bypass damper separates the two compartments, and control means for actuating the bypass damper when the outdoor air temperature falls below a predetermined temperature, e.g., 60° F., to permit air to pass from the inoperative second-stage compartment to the operating first-stage compartment to reduce the pressure differential across the condenser coil in the first-stage compartment thereby reducing the airflow over the first-stage coil and increasing the refrigerant pressure in said first-stage coil.

Other objects and advantages of the present invention will be made more apparent hereafter.

BRIEF DESCRIPTION OF THE DRAWING

There is shown in the attached drawing presently preferred embodiments of the present invention, wherein like numerals refer to like elements in the various views, and wherein:

FIG. 3 is a top plan view of another embodiment of condensing section embodying a rotatable damper means;

FIG. 4 is an end view of the condensing section of FIG. 3;

FIG. 5 is a side view of the condensing section of FIG. 3.

DETAILED DESCRIPTION OF THE PRESENT INVENTION

Figure 1:
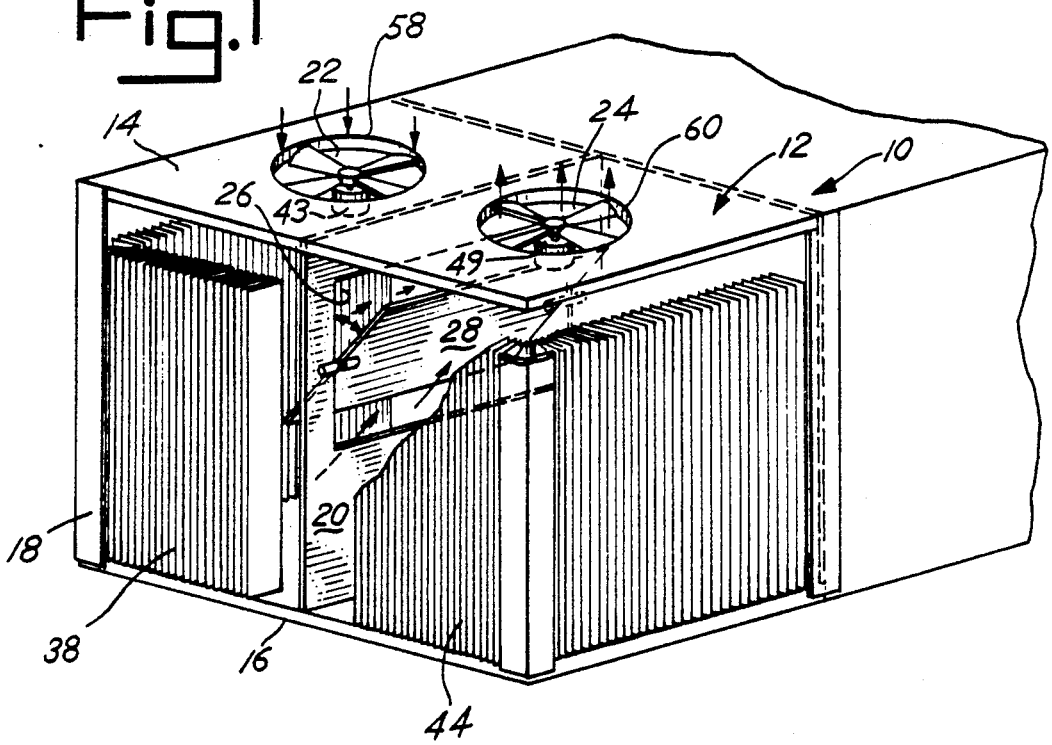
FIG. 1 is a perspective schematic view of one embodiment of the condensing section of a two-stage air conditioning system embodying a pivoted damper means in the common wall between two compartments in the condensing section.

Referring to FIG. 1, there is shown a condensing section 10 of an air conditioning system embodying the present invention. The condensing section 10 includes a housing 12 having a top 14, bottom 16, and sides 18. Wall 20 subdivides the housing 12 into two compartments 22 and 24.

The wall 20 has an opening 26 formed therein. Damper means 27 is provided to control the flow of air through opening 26. The damper means 27 comprises a plate-like damper 28 and control means 30 for actuating the damper 28. Damper 28 is pivotally secured at its ends to wall 20 and is adapted to open and close opening 26 so as to provide for selective flow of air through opening 26 as will be more fully explained hereinafter. Control means 30 in the form of a damper motor are provided to open the damper 28. The damper motor 30 is operatively connected to the damper 28 to open same. A spring (not shown in FIG. 1, but shown as 32 in FIG. 2) is adapted to close the damper 28.

Figure 2:
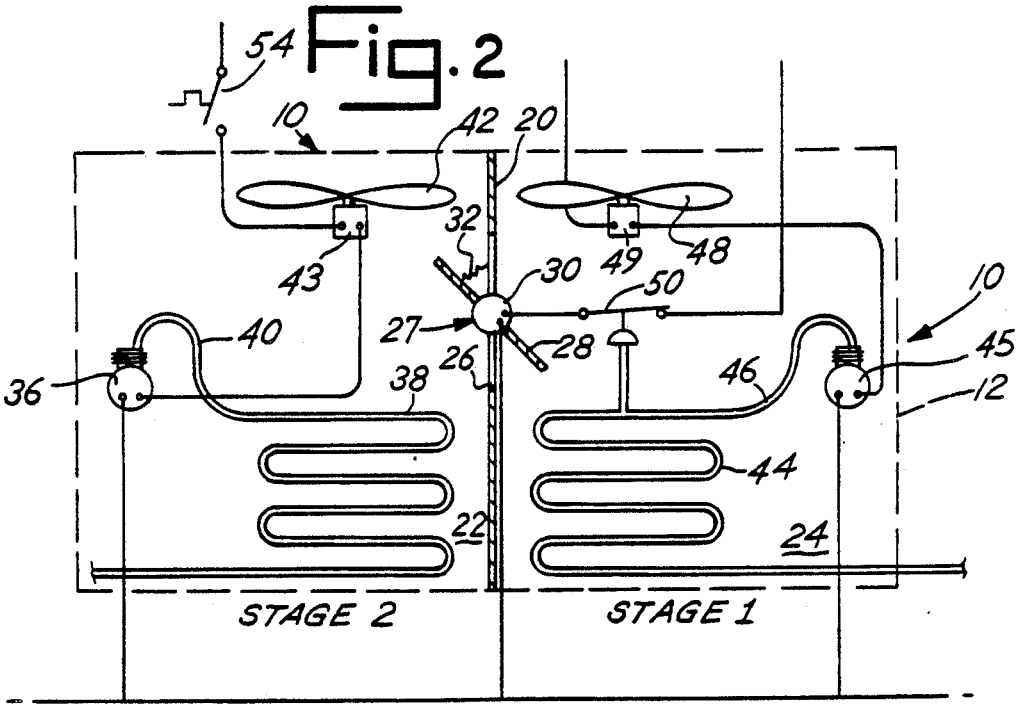
FIG. 2 is a schematic view of the two-stage air conditioning system, including the condensing section, of FIG. 1.

In FIG. 2, there is shown schematically the operating components within the housing 12 of the condensing section 10. Disposed in the compartment 22 is a compressor 36, a condenser coil 38 connected to the compressor 36 by discharge line 40 and a condenser fan 42. Condenser fan 42 is driven by a motor 43 for passing air over the condenser coil 38 to condense refrigerant therein received from compressor 36. Provided in the compartment 24 is a compressor 45 connected to a condenser coil 44 by a discharge line 46. Also, within compartment 24 is a condenser fan 48 driven by motor 49 for passing air over the condenser coil 44.

It will be understood that the condenser coils 38 and 44 are operatively connected in respective refrigeration systems with expansion means and an evaporator means, as is well known in the art. For purposes of explanation compartment 24 is considered to be the first stage compartment and compartment 22 is considered to be the second stage compartment.

. Bypass damper switch 50 is provided in circuit with the damper motor 30 for actuating the damper motor 30 to open the damper 28 so as to permit the bypass of air. Bypass damper switch 50 is actuated responsive to pressure within the discharge line 46.

Provided in circuit with the motor 43 for condenser fan 42 is a switch 54 responsive to ambient temperature for controlling the motor 43. Switch 54 is normally closed and is opened when the ambient temperature drops below a predetermined value, for example, 60° F.

Under normal operating conditions, in response to a demand for cooling, the first stage compressor 45 is actuated. The first stage will operate together with its refrigeration system components to provide cooling. Upon additional demand for cooling, the second stage compressor 36 will be actuated. The second stage will operate together with its refrigeration system components to provide additional cooling. Should the ambient temperature drop below a predetermined condition about 60° F., and there still be a need for cooling certain areas, switch 54 will be opened to deenergize compressor 36 and condenser fan motor 43 in the second stage compartment 22. As the outdoor temperature drops, the refrigerant pressure in the line 46 will fall, closing switch 50 and actuating bypass damper motor 30 to open the bypass damper 28. With the opening of the bypass damper 28, air may enter compartment 24 after passing through (1) fan opening 58 and (2) coil 38, as well as air passing through coil 44. This alternate supply of air from compartment 22 reduces the volume of air pulled across the coil 44 so the refrigerant therein takes longer to cool. The pressure in the discharge line 46 will rise to a predetermined level to open switch 50. The damper motor 30 is deenergized and spring 32 will bias the damper closed.

It has been determined that the air flow through the coil 44 in the first stage compartment would have to be reduced by at least 37 percent to significantly improve discharge pressure under low ambient temperature conditions. For one preferred embodiment, wherein each condenser fan moves 3200 cubic feet per minute (cfm) of air, the air flow over the coil 44 is reduced to 2000 cfm to obtain the desired improved operation. The area of the bypass opening 26 required is approximately 1.5 square feet. Enough air will enter from the compartment 22 to compartment 24 to reduce the air flow over coil 44 to 2000 cfm with a tolerable pressure drop on the order of 0.11 inch w.c. across the coil 44.

Turning to FIGS. 3, 4 and 5, there is shown a condensing section 10 as in FIGS. 1 and 2 having a modified form of damper means. In all other respects, the condensing section of FIGS. 3–5 may be the same as the embodiment of FIGS. 1 and 2. From the top view of the condensing section 10 in FIG. 3, it is seen that the fans 42 and 48 are associated with openings 58 and 60 in the top 14 of the housing 12.

The condenser coils 38 and 44 are conventional type tube and fin construction. In the illustrated embodiment of the invention they are generally L-shaped as viewed in plan.

From the end view of FIG. 4 it is seen that compressors 36 and 45 are positioned on the bottom 16 of housing 12.

Air enters the respective compartments 22 and 24 through condenser coils 38 and 44 respectively. Air is drawn in by the fans 42 and 48, respectively, and when the damper means is closed air is discharged through the openings 58 and 68, respectively. Compartment 24 may be regarded as the first-stage compartment and compartment 22 may be regarded as the second-stage compartment.

In the embodiment of FIGS. 3–5, the opening 126 is preferably in the form of a pair of opposed sector shapes and the damper means 127 comprises a rotatable damper 128 having a shape generally complementary to that of the opening 126. The opening 126 is shown open in FIG. 5. Damper motor 30 is operatively connected centrally to the damper 128 to rotate same to open and close the opening 126 to the flow of air.

In operation, as the outdoor temperature falls below a predetermined value, for example, about 60° F., the switch 54 opens, deenergizing compressor 36 and condenser fan motor 43. The discharge pressure in line 46 in the first stage compartment 24 falls, closing switch 50 and energizing bypass damper motor 30. This opens the bypass damper means 127 in FIGS. 3–5, allowing air to be drawn into compartment 24 from compartment 22. The air is discharged to the ambient by condenser fan 48. This results in a reduced pressure differential across the condenser coil 44, thus reducing the air flow across condenser coil 44. With the reduction in air flow, the discharge pressure in line 46 will rise to a predetermined level and act to open switch 50. The opening of switch 50 will deenergize the bypass damper motor 30. The return spring 32 will bias the damper 28 to the closed position in the embodiment of FIGS. 1 and 2. A return spring can be employed with the embodiment of FIGS. 3–5, or the damper motor 30 may be actuated to rotate the damper 128 to the closed position.

While I have shown presently preferred embodiments of the present invention, it will be understood that various changes and modifications may be made in the invention and it is intended that the invention will be limited only within the scope of the appended claims.

I claim:

1. A condensing unit having a housing with a first stage compartment and a second stage compartment therein separated by a common wall, a compressor, condenser coil and a condenser fan in each compartment, said compressor and condenser coil in each compartment being operatively interconnected, a bypass opening in said common wall, a damper operatively associated with said bypass opening for opening and closing same, a damper motor for actuating said damper in response to attainment of a predetermined condition, whereby below said predetermined condition the damper motor is actuated to open the damper, allowing air to be drawn from the second compartment through the first compartment, and resulting in a reduced pressure differential across the condenser coil in the first compartment and a reduction in the air flow across the condenser coil in the first compartment, and with the reduction in the air flow across the condenser coil in the first compartment, the predetermined condition will be restored and the damper will be closed.

2. A condensing unit as in claim 1 including control means for actuating the damper motor.

3. A condensing unit as in claim 2 wherein the control means includes a bypass damper switch in circuit with the damper motor.

4. A condensing unit as in claim 3 wherein the bypass damper switch is actuated responsive to pressure within the line connecting the compressor and condenser coil in the first stage compartment.

5. A condensing unit as in claim 1 wherein the damper comprises a plate pivotally secured to said common wall.

6. A condensing unit as in claim 1 wherein the damper is rotatably secured to said common wall.

7. A condensing unit having a housing with a first compartment and a second compartment therein, a wall between said first compartment and said second compartment, each compartment communicating with the ambient, a first compressor, condenser coil and condenser fan in said first compartment, a second compressor, condenser coil and condenser fan in said second compartment, said compressor and condenser coil in each compartment being operatively interconnected, a bypass opening in said wall, damper means operatively associated with said bypass opening for opening and closing same, a damper motor for actuating said damper in response to attainment of a predetermined condition, and control means for said damper motor, whereby below said predetermined condition the damper motor is actuated to open the damper means, allowing air to be drawn from the second compartment through the first compartment, and resulting in a reduced pressure differential across the condenser coil in the first compartment and a reduction in the air flow across the condenser coil in the first compartment, and with the reduction in the air flow across the condenser coil in the first compartment, the predetermined condition will be restored and the damper means will be closed.

8. A condensing unit as in claim 7 wherein the control means operates to open the damper means upon attainment of a predetermined pressure and including means for closing the damper.

9. A condensing unit as in claim 7 wherein the control means includes a discharge pressure switch operatively connected to said damper motor for actuating same.

10. A condensing unit as in claim 9 including a thermostat means responsive to ambient temperature for actuating said compressor and fan in said second stage compartment.

11. A condensing unit as in claim 7 wherein the damper means comprises a plate pivotally secured to said wall.

12. A condensing unit as in claim 7 wherein the damper means comprises a damper rotatably secured to said wall.

* * * * *